US010988930B2

(12) United States Patent
Park

(10) Patent No.: US 10,988,930 B2
(45) Date of Patent: Apr. 27, 2021

(54) V-SHAPED TIE REINFORCEMENT INTEGRALLY PROVIDED WITH ONE-TOUCH FIXING DEVICE

(71) Applicant: Seong-Wook Park, Seoul (KR)

(72) Inventor: Seong-Wook Park, Seoul (KR)

( * ) Notice: Subject to any disclaimer, the term of this patent is extended or adjusted under 35 U.S.C. 154(b) by 0 days.

(21) Appl. No.: 16/639,938

(22) PCT Filed: Aug. 2, 2018

(86) PCT No.: PCT/KR2018/008781
§ 371 (c)(1),
(2) Date: Feb. 18, 2020

(87) PCT Pub. No.: WO2019/045292
PCT Pub. Date: Mar. 7, 2019

(65) Prior Publication Data

US 2020/0248454 A1 Aug. 6, 2020

(30) Foreign Application Priority Data

Aug. 28, 2017 (KR) ..... 10-2017-0108455

(51) Int. Cl.
*E04C 5/16* (2006.01)
*E04C 5/06* (2006.01)

(52) U.S. Cl.
CPC ..... *E04C 5/167* (2013.01); *E04C 5/0604* (2013.01); *E04C 5/162* (2013.01)

(58) Field of Classification Search
CPC ..... E04C 5/167; E04C 5/162; E04C 5/166; E04C 5/06; E04C 5/03; E04C 5/0604; E04C 5/0622
(Continued)

(56) References Cited

U.S. PATENT DOCUMENTS 1,457,610 A * 6/1923 White ..... E04C 5/18 52/688
3,289,378 A * 12/1966 Carroll ..... E04C 5/18 52/688
(Continued)

FOREIGN PATENT DOCUMENTS

JP 3188340 U 1/2014
KR 10-1418689 B1 7/2014
(Continued)

*Primary Examiner* — Adriana Figueroa
(74) *Attorney, Agent, or Firm* — Novick, Kim & Lee, PLLC; Jae Youn Kim

(57) ABSTRACT

The present invention relates to a V-shaped tie reinforcement for reinforcing a hoop reinforcement installed around a main reinforcement, wherein the V-shaped tie reinforcement is installed in order to prevent deformation, such as buckling, of the main reinforcement installed on a long member of an RC structure or an SRC structure, such as a column or a compression beam while preventing brittle fracturing of concrete. The present invention comprises: a V-shaped reinforcement composed of a bent part having a shape surrounding a main reinforcement at the center thereof and an anchor part open at both sides; and a fixing means composed of an upper tie reinforcement fixing brace fixedly installed at the V-shaped reinforcement and connected to the main reinforcement, and a rotation preventing brace fixedly installed at the bent part of the V-shaped reinforcement and preventing the V-shaped reinforcement connected to the main reinforcement from rotating upward and downward and right and left.

12 Claims, 16 Drawing Sheets

(58) Field of Classification Search
USPC ..... 52/677, 688
See application file for complete search history.

(56) References Cited

U.S. PATENT DOCUMENTS

| | | | | | |
|---|---|---|---|---|---|
| 4,249,354 | A * | 2/1981 | Wynn | E04B 2/8629 | 52/309.12 |
| 4,463,538 | A * | 8/1984 | Dragunas | E04C 5/0604 | 52/677 |
| 6,637,171 | B1 * | 10/2003 | Toone | E04C 5/167 | 248/156 |
| 6,849,318 | B1 | 2/2005 | Davidson | | |
| 10,017,942 | B2 * | 7/2018 | McCarthy | E04C 5/06 | |
| 2012/0137618 | A1 * | 6/2012 | Martter | E04C 5/0645 | 52/649.1 |
| 2012/0137619 | A1 * | 6/2012 | Martter | E04C 5/0645 | 52/649.1 |

FOREIGN PATENT DOCUMENTS

| | | | | | |
|---|---|---|---|---|---|
| KR | 10-2015-0110280 | A | 10/2015 | | |
| KR | 10-1750792 | B1 | 6/2017 | | |
| WO | WO-2015147415 | A1 * | 10/2015 | E04C 5/167 | |
| WO | WO-2019093540 | A1 * | 5/2019 | E04C 5/06 | |
| WO | WO-2019093541 | A1 * | 5/2019 | E04C 5/06 | |

* cited by examiner

V-SHAPED TIE REINFORCEMENT INTEGRALLY PROVIDED WITH ONE-TOUCH FIXING DEVICE

BACKGROUND OF THE INVENTION

1. Field of the Invention

The present invention relates to an auxiliary hoop reinforcement for reinforcing a hoop reinforcement installed around a main reinforcement, which is installed to prevent concrete from being brittle-fractured while preventing deformation such as buckling of the main reinforcement installed in a lengthwise member of an RC construction or an SRC construction, such as a column or a compressed beam.

2. Description of the Prior Art

Hoop reinforcements are installed around vertical reinforcements buried in concrete of an RC column, and the hoop reinforcements resists against the shear force while securing the locations of the vertical reinforcements in a column, and prevents concrete from brittle-fractured, by preventing buckling of the vertical reinforcements.

The hoop reinforcements are generally disposed to surround the vertical reinforcements, but when the arrangement intervals of the vertical reinforcements are widened or the number of the main reinforcements is large, auxiliary hoop reinforcements of various shapes are additionally installed.

FIG. 1 illustrates planes in a state in which the auxiliary hoop reinforcement is arranged. Conventionally, as illustrated in FIG. 1*a*, hooks are formed at opposite ends of the auxiliary hoop reinforcement to have a shape that is hooked by the vertical reinforcement, and it is preferable that ends of both the hooks have a standard hook A having an angle 135°, but it is general that a 90° standard hook B may be provided on one side of the hook because the insertion of the hook into the vertical reinforcement is not easy.

However, when the 90° standard hook is easily released from the vertical reinforcement and a compression force and a bending moment are generated at the same time, for example, due to an earthquake, the hoop reinforcement and the auxiliary hoop reinforcement cannot confine the vertical reinforcement, and and a brittle fracture by which the column is not flexibly deformed and is abruptly collapse due to buckling.

In order to solve the problems, in recent years, as illustrated in FIG. 1*b*, the number of cases in which V-shaped tie reinforcements are used as the auxiliary hoop reinforcements has been increasing.

Because the V-shaped tie reinforcement grips the vertical reinforcement as if it surrounds the vertical reinforcement while opposite ends of the V-shaped reinforcement is buried in concrete to be anchored, buckling of the vertical reinforcement is efficiently prevented as the hooks are prevented from being released.

Meanwhile, the V-shaped tie reinforcement, the center of which is bent such that the V-shaped tie reinforcement is installed vertically with respect to the vertical reinforcement, has to be coupled to the vertical reinforcement such that location thereof is fixed, and FIG. 2 illustrates a reinforcement fixing tool that may be applied thereto.

The reinforcement fixing tool 3 is disclosed in Japanese Patent Application Publication No. 2012-31660, and includes an arc-shaped clip 3, into which the main reinforcement 1 is inserted to be fixed, and an insertion/holding part 34, into which opposite sides of a bent reinforcement 2 to be fixed. The reinforcement fixing tool 3 is manufactured in advance in the factory, and is simply fixed to the reinforcement in an attachment and insertion manner in the field, and thus the operation performance of the field can be improved.

However, the reinforcement fixing tool 3 of the prior art has the following problems.

First, the reinforcement fixing tool 3 cannot properly control horizontal rotation of the V-shaped tie reinforcement due to an impact.

The V-shaped tie reinforcement is installed such that the bent central portion acts as a one-point support, and opposite ends thereof have the form of free ends that are not fixed to any sites before concrete is poured. Accordingly, a horizontal external force may be applied due to a carelessness of an operator or while concrete is poured, and the V-shaped tie reinforcement is rotated leftwards and rightwards about the circular arc-shaped clip 31 together with the reinforcement fixing tool 3 and loses its function as an auxiliary reinforcement.

Second, the arc-shaped clip 31 of the reinforcement fixing tool 3 that grips the main reinforcement 1 has a flattened single surface that is vulnerable to slide in a upward and downward direction, in spite that it receives all the loads of the V-shaped time reinforcement. Accordingly, the V-shaped tie reinforcement cannot maintain its proper location and may move upwards or downwards due to a carelessness of the operator or while concrete is poured.

Third, the reinforcement fixing tool 3 has to be manufactured by injection-molding a synthetic resin due to the characteristics of its shape. However, the synthetic resin deteriorates a synthesizing force between the reinforcement and the concrete and causes a sectional loss, and may hinder the durability of concrete, for example, due to cracks by decreasing the confinement of the concrete due to separation of the concrete by foreign substances and a difficulty in filling the concrete.

SUMMARY OF THE INVENTION

The present invention has been made in an effort to solve the problems of the conventional technology, and provides a V-shaped tie reinforcement provided with a one-touch type fixing device which may be conveniently installed, which reduces the amount of the operation in the field, which maintains the set shape even if an unpredicted external force is applied in various directions and maintains the proper location thereof to achieve an improved construction performance, an economical aspect of a short construction period, and a high construction quality.

In accordance with an aspect of the present invention, a V-shaped tie reinforcement integrally provided with a one-touch type fixing device, the V-shaped tie reinforcement includes: a V-shaped reinforcement including a bending part having a shape surrounding a main reinforcement at the center thereof, and anchor parts widened to two sides; and a fixing device including a tie reinforcement upper fixing member fixedly installed in the V-shaped reinforcement and connected to the main reinforcement, and a rotation preventing member fixedly installed in the bending part of the V-shaped reinforcement and configured to prevent the V-shaped reinforcement connected to the main reinforcement from rotating to the upper, lower, left, and right sides, wherein the tie reinforcement upper fixing member includes: an arc-shaped clip having an insertion hole, into which the main reinforcement is inserted; and upper support bars horizontally bent outwards from opposite ends of the insertion hole and ends of which are fixed to the anchor parts of the V-shaped reinforcement, and wherein the rotation preventing member includes: a hanging/fixing bar installed to be hung on the upper surface of the V-shaped reinforcement; and a pair of prop bars bent downwards from opposite ends of the hanging/fixing bar.

The upper support bars may be bent to be inclined vertically downwardly from the opposite ends of the insertion hole and ends of the upper support bars may be attached and fixed to the anchor parts of the V-shaped reinforcement.

Annular ring or an arc-shaped clips, into which the anchor parts are inserted to be fixed, may be further provided at ends of the upper support bar.

The rotation preventing member may be configured such that the outer surface of a prop bar is located on the inner surface of a hoop reinforcement surrounding the main reinforcement, and a pair of cross fixing clips located at ends of the extending support bars and into which the main reinforcement is inserted may be further provided.

The V-shaped tie reinforcement may further include a pair of extending support bars extending downwards from the annular rings or the arc-shaped clips provided in the pair of upper support bars and bent to be inclined downwards to be symmetrical to the upper support bars; and a pair of cross fixing clips located at ends of the extending support bars and into which the main reinforcement is inserted.

The tie reinforcement upper fixing member may be fixedly installed at an upper portion of the V-shaped reinforcement, and in the same way as the upper support bar, tie reinforcement lower fixing members having annular rings or arc-shaped clips configured to fix the anchor parts of the V-shaped reinforcement at ends thereof are further installed at lower portions of the V-shaped reinforcement, and the tie reinforcement lower fixing member may include an arc-shaped clip having an insertion hole, into which the main reinforcement is inserted; and lower support bars bent horizontally outwards at opposite ends of an insertion hole and ends of which are fixed to the anchor parts of the V-shaped reinforcement.

A protruding recess for coupling to the V-shaped reinforcement may be further formed at the center of the rear surface of each of the arc-shaped clips provided in the tie reinforcement upper fixing member and the tie reinforcement lower fixing member.

The insertion hole of the tie reinforcement upper fixing member may be configured to have an inverse V shape such that the arc-shaped clip is bent upwards from the protruding recess and the upper support bar is bent downwards from the arc-shaped clip, the insertion hole of the tie reinforcement lower fixing member may be configured to have a V shape such that the arc-shaped clip is bent downwards from the protruding recess and the lower support bar is bent upwards from the arc-shaped clip, and the upper and lower arc-shaped clips surround the outer surface of the main reinforcement, which is inserted into the arc-shaped clips at opposite inclination angles.

The hanging/fixing bar of the rotation preventing member is welded and fixed to the upper surface of the V-shaped reinforcement.

The tie reinforcement upper fixing member and the tie reinforcement lower fixing member may be fixed to the bending part through welding or by a coupling accessory, and the rotation preventing member may be fixed simultaneously or separately.

The present invention shows an excellent operation performance because the V-shaped tie reinforcement is coupled to the main reinforcement simply by pushing the V-shaped tie reinforcement toward the main reinforcement in a one-touch scheme by using an entrance guide operation by the upper support bards and an elastic operation of the arc-shaped clips, and shows a high coupling stability because horizontal separation of the coupling V-shaped tie reinforcement is suppressed by the axial forces of the upper support bars and the prop bars of the rotation preventing member.

Further, the present invention perfectly prevents the V-shaped reinforcement from rotating to the left and right sides by the prop bars of the rotation preventing member, restrains the V-shaped tie reinforcement from moving upwards by the prop bars and the extending support bars, the arc-shaped clips of the upper and lower fixing members coupled to the main reinforcement to be inclined, and the outer surfaces of the upward/downward convexo-concave shape by the arc-shaped clip of the upper and lower fixing members and the V-shaped reinforcement, and restrains the V-shaped reinforcement from being deflected downwards or rotating by the prop bars of the rotation preventing member, the configuration in which the arc-shaped clips are spaced apart from the V-shaped reinforcement so that the anchor parts of the V-shaped reinforcement are hung by the upper support bar, and the configuration inn which the upper and lower sides of the V-shaped reinforcement is vertically fixed at two points by the upper and lower fixing members.

Accordingly, a planned arrangement state of the main reinforcement can be maintained in spite of various impacts that may be generated due to a carelessness of an operator or while concrete is poured, the fixing device formed of the same material as the reinforcement can increase the coupling force of the main reinforcement with the function of the shear connecting member to the concrete and can prevent cracking or separation of concrete at the coupling portions, and the high quality of the members can be achieved because a sectional loss due to the foreign substance in the interior of the members does not occur.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE EXEMPLARY EMBODIMENTS

Hereinafter, embodiments of the present invention will be described in detail with reference to the accompanying drawings.

However, in a description of the present invention, a detailed description of known configurations will be omitted when it may make the technical spirits of the present invention rather unclear.

Figure 1A:
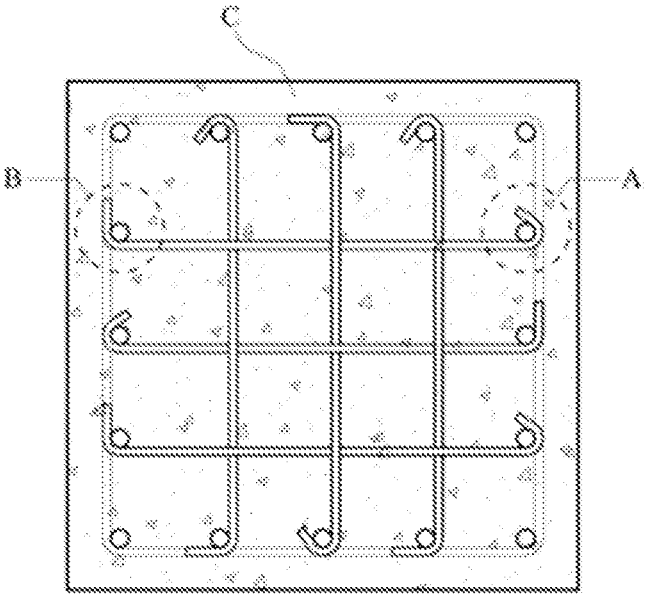
FIGS. 1A and 1B illustrate plan views of states in which a conventional auxiliary tie reinforcement is disposed.
Figure 1B:
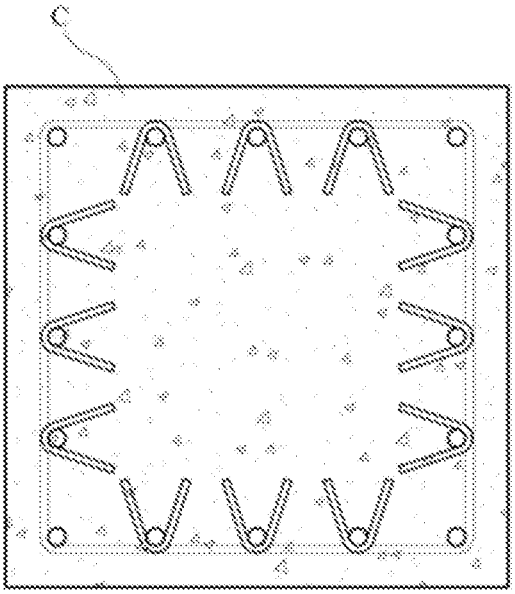
Figure 2:
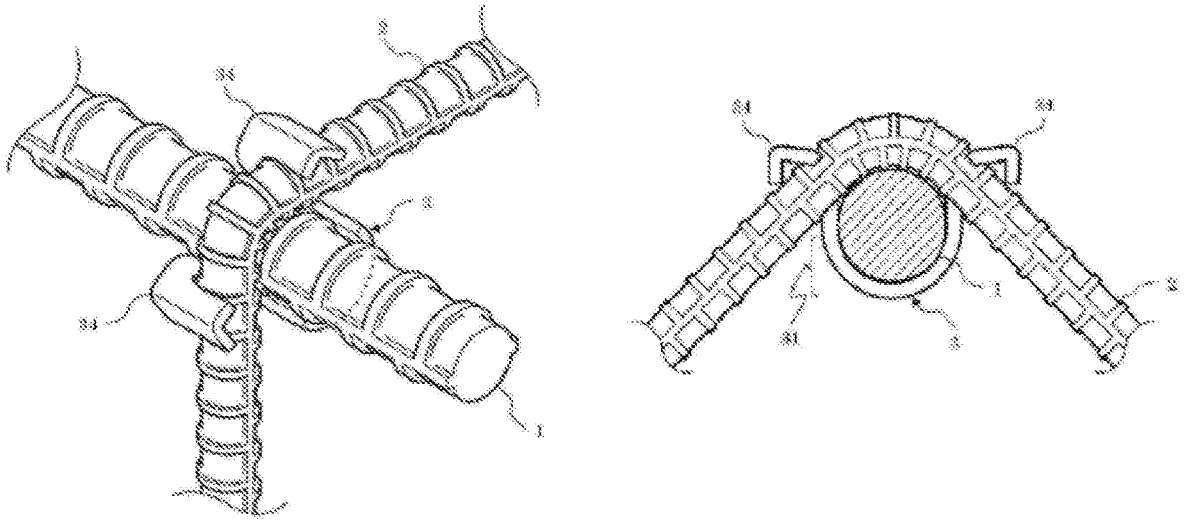
FIG. 2 illustrates a perspective view and a plan view of a conventional reinforcement fixing device capable of fixing a V-shaped tie reinforcement.
Figure 3:
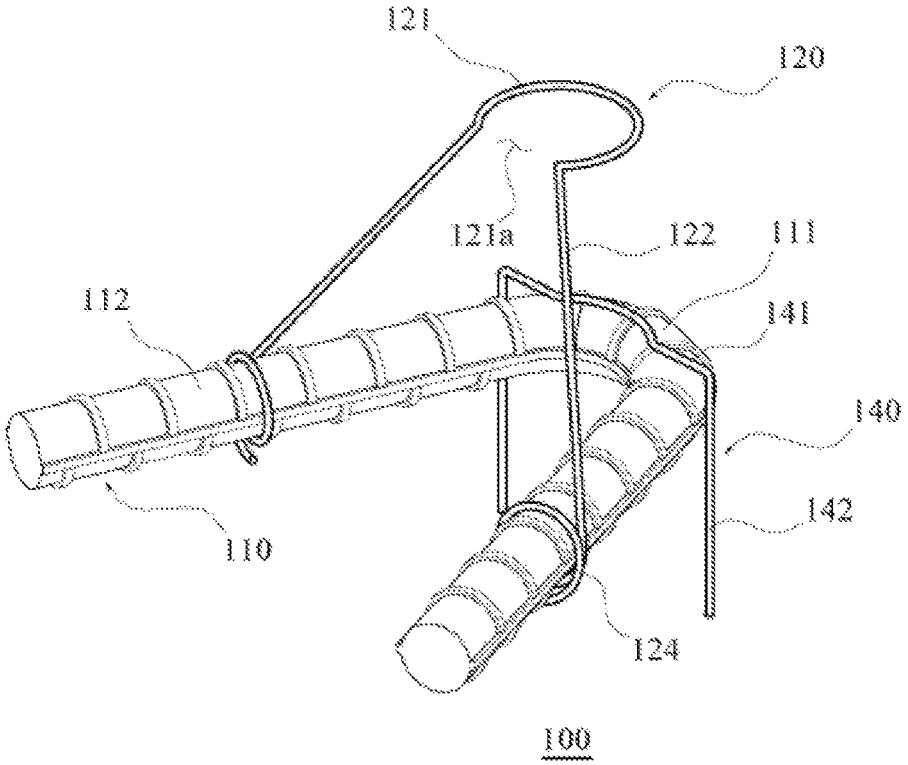
FIGS. 3 to 5 are perspective views of a V-shaped tie reinforcement according to a first embodiment of the present invention.
Figure 4:
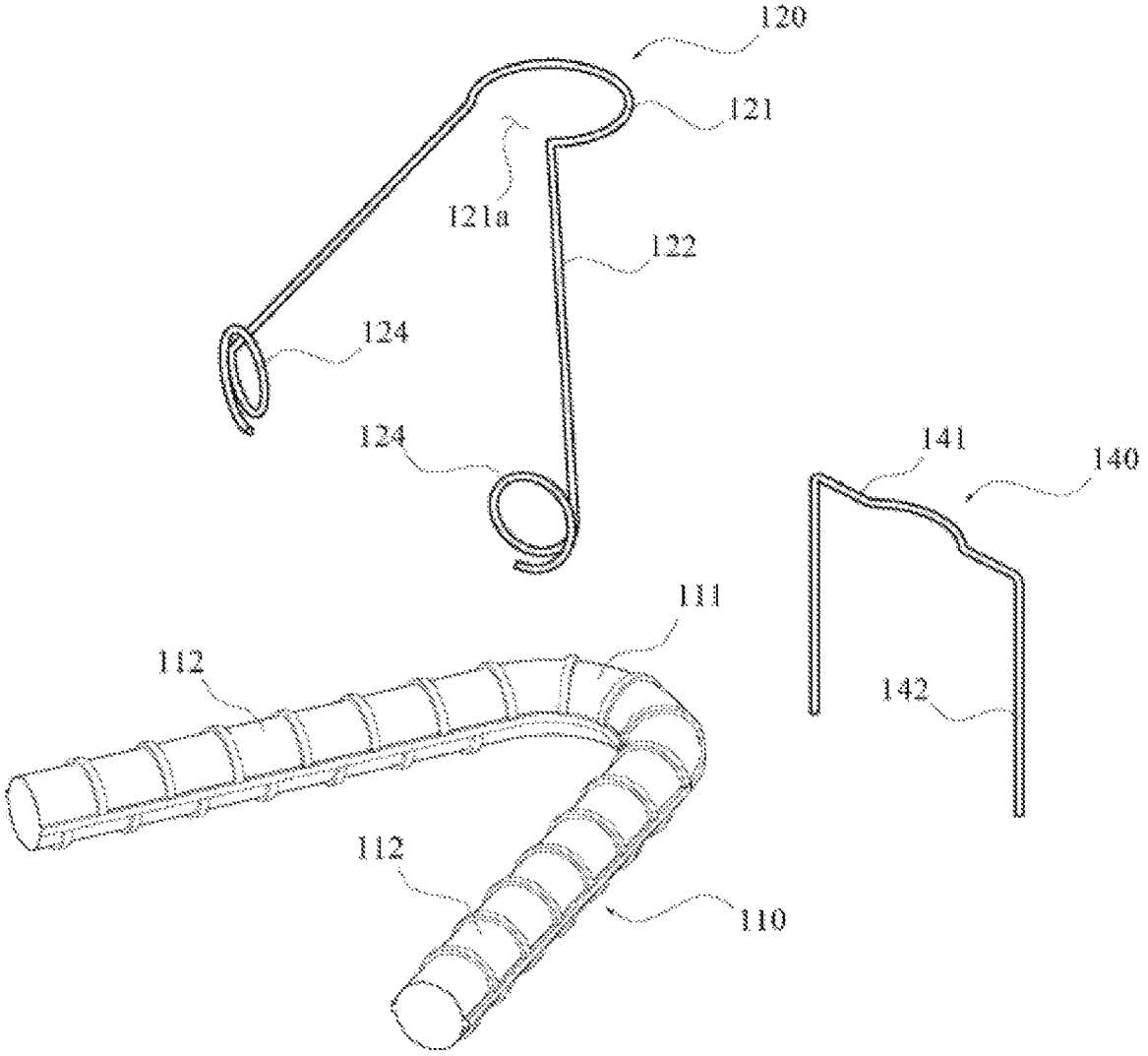
Figure 5:
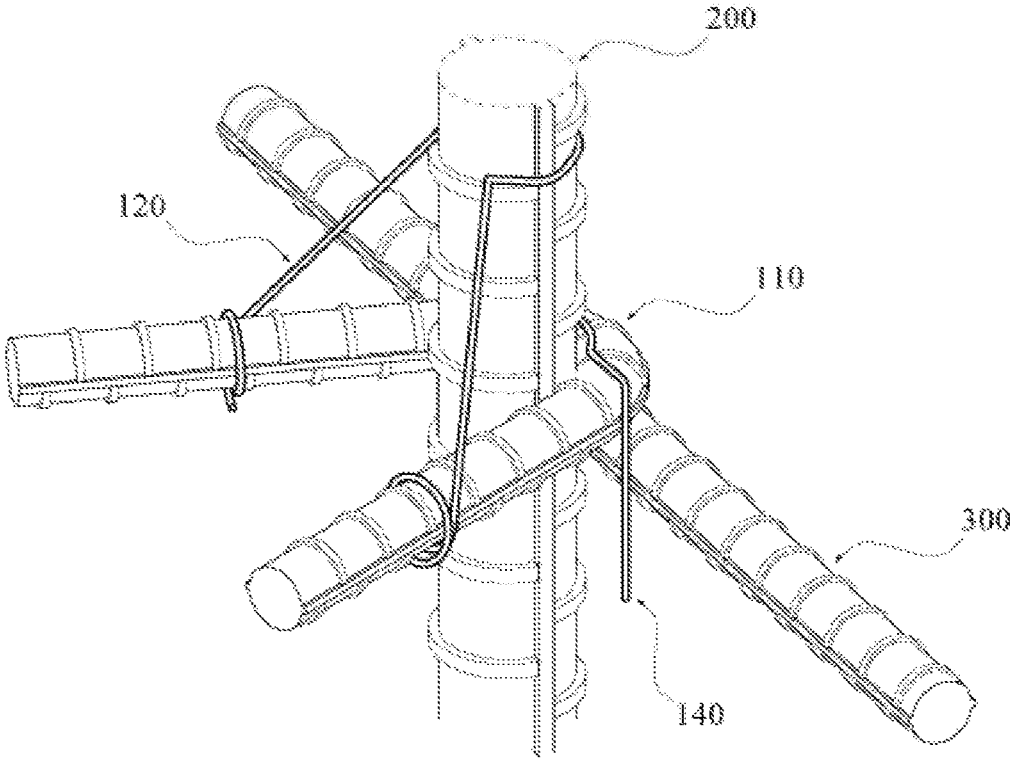

FIGS. 3 to 5 relate to a V-shaped tie reinforcement 100 according to a first embodiment of the present invention. FIG. 3 is a perspective view illustrating the entire V-shaped tie reinforcement 100. FIG. 4 is an exploded perspective view illustrating configurations of the V-shaped tie reinforcement 100. FIG. 5 is a perspective view illustrating a state in which the V-shaped tie reinforcement 100 is installed in a main reinforcement 200.

The present invention relates to an auxiliary tie reinforcement in which a rectangular column tie reinforcement 300 (hereinafter, referred to as 'a hoop reinforcement'), which surrounds main reinforcements 200 installed at an edge of a large-section member, is additionally installed at an upper portion thereof, and as illustrated in FIGS. 3 and 5, includes a V-shaped reinforcement 110 including a bending part 111 having a shape surrounding a main reinforcement 200 at the center thereof and an anchor part 112 widened to two sides, and a one-touch type fixing device integrally provided in the V-shaped reinforcement 110.

The angle of the bending part 111 of the V-shaped reinforcement 110 and the length of the anchor part 112 absolutely influence the degree by which the main reinforcement 200 is confined, but may be optimally selected according to the size of the section of the member, the interval of the main reinforcement 200 disposed therein, and the size of the tie reinforcement, and the present invention is not specifically limited in this aspect.

The one-touch type fixing device is fixedly installed in the V-shaped reinforcement 110, and includes a tie reinforcement upper fixing member 120 connected to the main reinforcement 200, and a rotation preventing member 140 that prevents the V-shaped reinforcement 110 connected to the main reinforcement 200 from rotating to the upper, lower, left, and right sides.

It is preferable that the tie reinforcement upper fixing member 120 and the tie reinforcement lower fixing member 130, which will be described below, are formed of a steel wire of an elastic material, and this provides a function of a shear connection material between the reinforcements and concrete while making it easy to install the main reinforcement 200 in a one-touch type by an elastic force of the fixing device, prevents separation of coupling portions due to coincidence of their linear expansion coefficient, and provides the member with a sufficient cross-sectional force by preventing a sectional loss in the interior of the member.

The tie reinforcement upper fixing member 120 is installed to be located at an upper portion of the V-shaped reinforcement 110, and includes an arc-shaped clip 121 coupled to the main reinforcement 200, and upper support bars 122 bent horizontally outwards from two ends of the insertion hole 121*a*, which will be described below, and end of which are fixed to the anchor parts 122 of the V-shaped reinforcement 110.

The arc-shaped clip 121 is configured such that the main reinforcement 200 is inserted into the interior space thereof to be fixed, and the insertion hole 121*a* is formed on a front surface thereof.

Then, the width of the insertion hole 121*a* is made to be smaller than the diameter of the interior space not to be easily separated once the main reinforcement 200 is inserted into the interior space. Accordingly, after being inserted through the insertion hole 121*a* widened in the elasticity range of the arc-shaped clip 121, the main reinforcement 200 is fixed by the elastically restored arc-shaped clip 121 after being inserted into the interior space.

The upper support bars 122, ends of which are fixed to the anchor parts 112 of the V-shaped reinforcement 110 are bent outwards at the opposite ends of the insertion hole 121*a* of the arc-shaped clip 121 configured to set the width of the insertion hole 121*a*, and is formed in a linear shape.

That is, the pair of upper support bars 122 located at the opposite ends of the arc-shaped clip 121 define a V shape, and the angle of the V shape is made to be larger than the angle of the bending part 111 in the V-shaped reinforcement 110.

The difference of the angles causes the pair of upper support bars 122 to be located inside the anchor parts 112 of the V-shaped reinforcement 110, whereby the insertion of the main reinforcement 200 into the interior space of the arc-shaped clip 121 is guided, the arc-shaped clip 121 is widened so that the elastic behavior of the arc-shaped clip 121 is efficiently made and thus the insertion of the main reinforcement 200 is easily made in a one-touch type, and the main reinforcement 200 inserted into the interior space of the arc-shaped clip 121 is propped by the lengthwise axial force not to be separated, and the V-shaped reinforcement 110 may be stably settled and fixed to the main reinforcement 200.

Figure 6A:
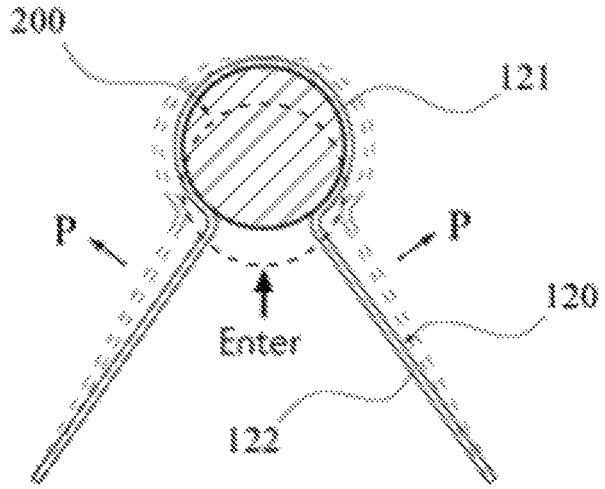
FIGS. 6A and 6B illustrate a plan view and a cross-sectional view illustrating operational relationships of some configurations of a fixing device for coupling the V-shaped tie reinforcement to a main reinforcement according to the present invention.
Figure 6B:
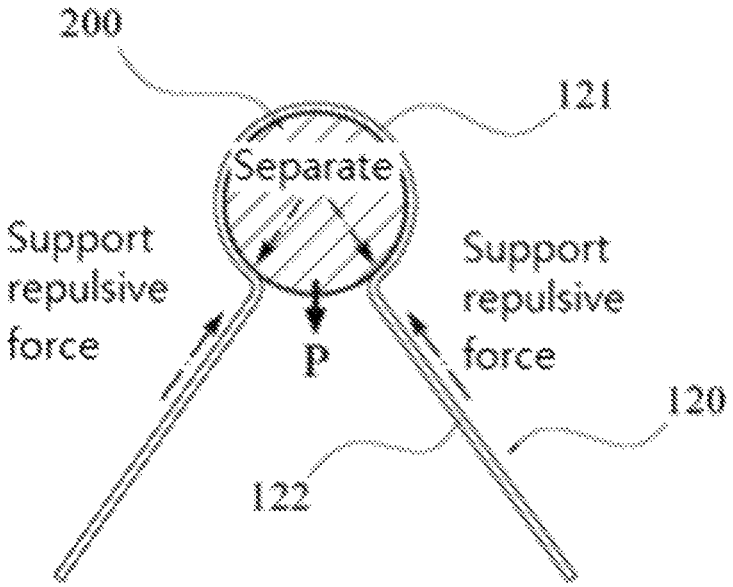

FIG. 6 is provided to explain the operational effects by the pair of upper support bars 122, in which FIG. 6A illustrates a process of inserting the main reinforcement 200 into the interior space of the arc-shaped clip 121 according to the guide of the upper support bars 122, and FIG. 6B illustrates a repulsive relationship of the upper support bars 122 that prevents separation of the main reinforcement 200 inserted into the interior space of the arc-shaped clip 121. The operational effects of the upper support bars 122 are also shown in the second and third embodiments, which will be described, as well as in the present embodiment.

The center of the rear surface of the arc-shaped clip 121, as in the third embodiment, which will be described below, may be welded and fixed to the V-shaped reinforcement 110, but is located at a height spaced apart upwards from the V-shaped reinforcement 110 in the present embodiment, and the location of the arc-shaped clip 121 is maintained by the upper support bars 122 fixed to the anchor part 122.

Accordingly, the upper support bars 122 of the present embodiment, as described above, are bent horizontally outwards from the opposite ends of the insertion hole 121*a* of the arc-shaped clip 121 and are bent to be inclined downwards at the same time, and ends of the upper support bars 122 are fixed to the anchor part 112 of the V-shaped reinforcement 110.

The upper support bars 122 that cause the arc-shaped clip 121 fixed to the main reinforcement 200 to be located at a height spaced upwards apart from the V-shaped reinforcement 110 in this way are hung toward the free ends of the V-shaped reinforcement 110 and prevents the ends of the V-shaped reinforcement 110 from rotating while being deflected downwards together with the prop bars 142, which will be described below.

The ends of the upper support bars 122 may be fixed to the anchor parts 112 through welding, and may be fixed by inserting the anchor parts 112 of the V-shaped reinforcement 110 into the annular rings 124 after providing the annular rings 124 at the ends of the upper support bars 122. Further, the shape of the annular rings 124 is not limited as long as the coupling is possible, for example, by using arc-shaped clips.

A rotation preventing member 140 is fixed to and installed in the bending part 111 of the V-shaped reinforcement 110. The rotation preventing member 140 prevents the V-shaped reinforcement 110 from rotating leftwards and rightwards, or rotating upwards and downwards, for example, ends thereof from being raised upwards or being deflected downwards while the hoop reinforcement 300 is taken as a support point. The rotation preventing member 140 is applied commonly to all the embodiments of the present invention, and a detailed description thereof will be described later separately.

Figure 7:
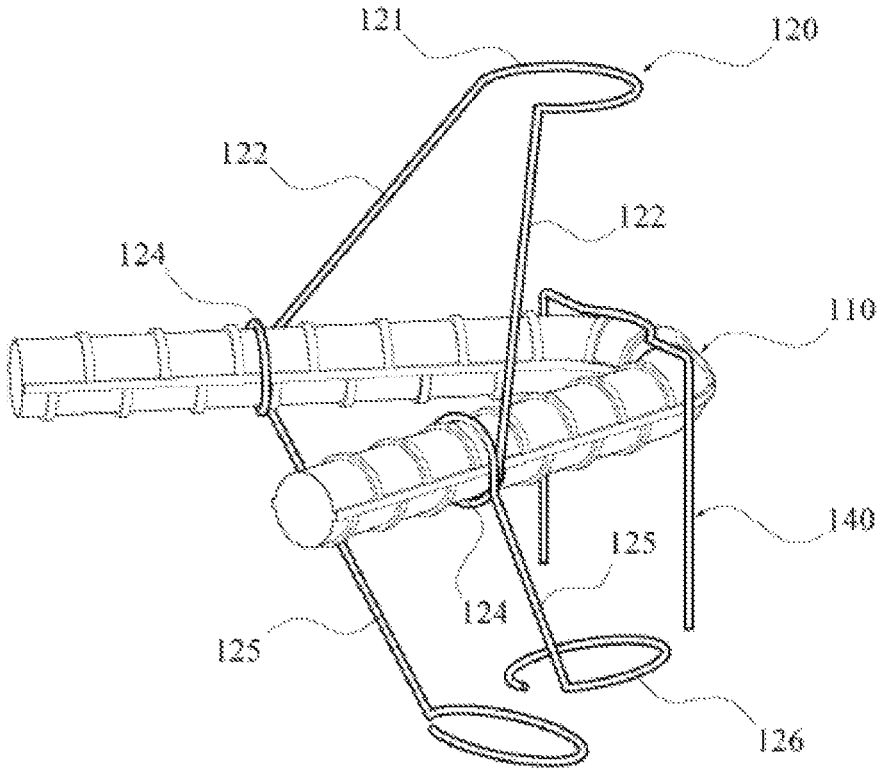
FIGS. 7 to 9 are perspective views of a V-shaped tie reinforcement according to a second embodiment of the present invention.
Figure 8:
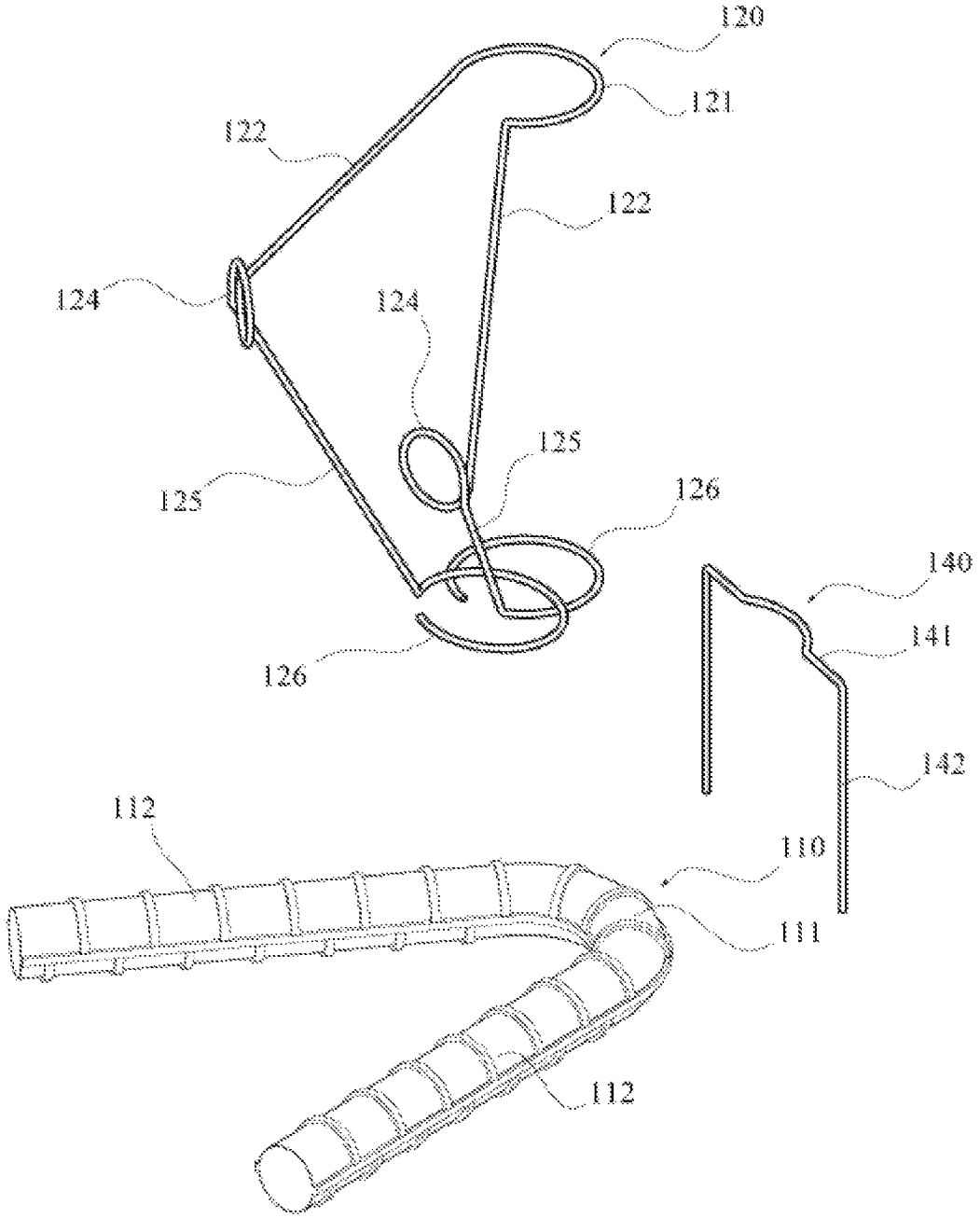
Figure 9:
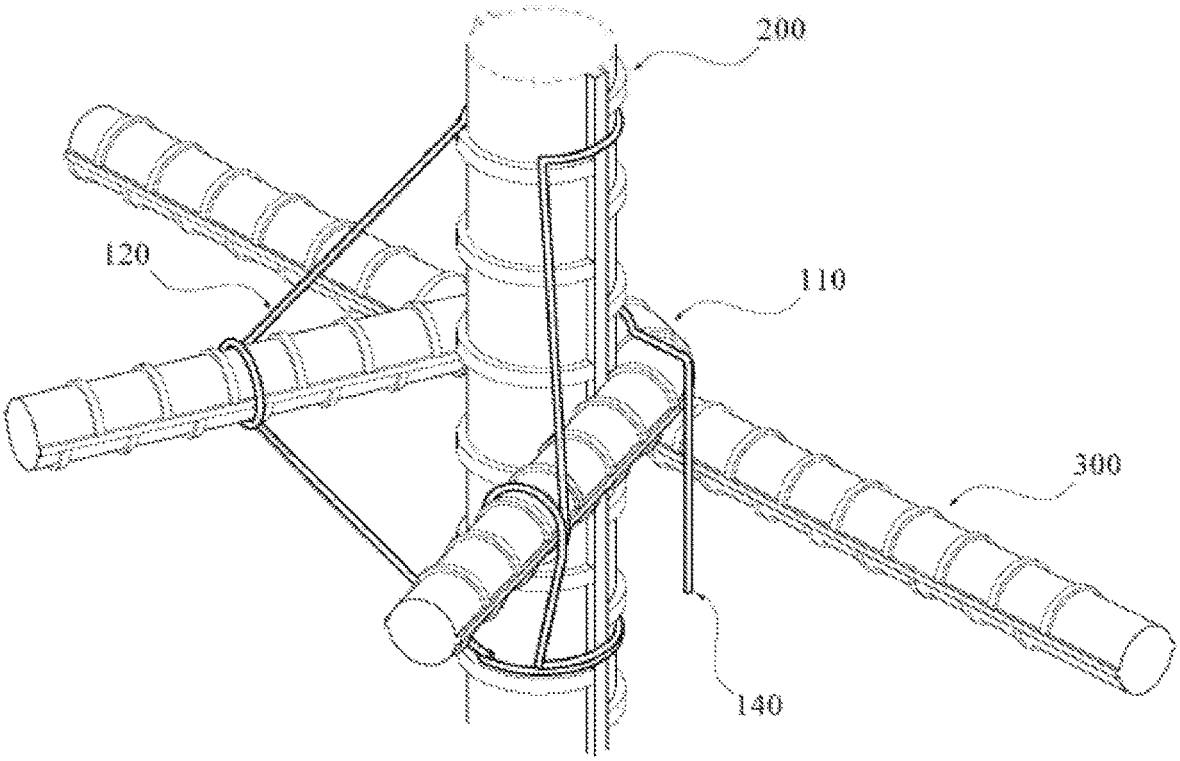

FIGS. 7 to 9 relate to a V-shaped tie reinforcement 100 according to a second embodiment of the present invention. FIG. 7 is a perspective view illustrating the entire V-shaped tie reinforcement 100. FIG. 8 is an exploded perspective view illustrating configurations of the V-shaped tie reinforcement 100. FIG. 9 is a perspective view illustrating a state in which the V-shaped tie reinforcement 100 is installed in a main reinforcement 200.

Ends of the upper support bars 122 may be fixed to the anchor parts 122 of the V-shaped tie reinforcement 100 according to the first embodiment by the annular rings 124 or the arc-shaped clips provided at the ends thereof, and in the second embodiment, the present invention further includes a pair of extending support bars 125 extending downwards from the annular rings 124 or the arc-shaped clips provided at ends of the pair of upper support bars 122, and a pair of cross fixing clips 126 located at ends of the extending support bars 125.

The extending support bars 125 are bent to be inclined downwards to be symmetrical to the upper support bars 122, and are fixed to a portion of the main reinforcement 200, which is located below of the lower side of the V-shaped reinforcement 110, by the pair of cross fixing clips 126.

Then, it is preferable that the openings, into which the main reinforcement 200 are inserted, of the pair of cross fixing clips that fix the extending support bars 125 to the main reinforcement 200 are formed to be opposite to each other so that the inserted main reinforcement 200 is not easily separated.

The extending support bars 125 that connect the V-shaped reinforcement 110 and the main reinforcement 200 by the annular rings 124 or the arc-shaped clips and the cross fixing clips 126 prevent ends of the V-shaped reinforcement 110 from rotating upwards by a load (for example, an upward movement load for extending a tremie pipe) that faces upwards during a processing of pouring concrete.

Figure 10:
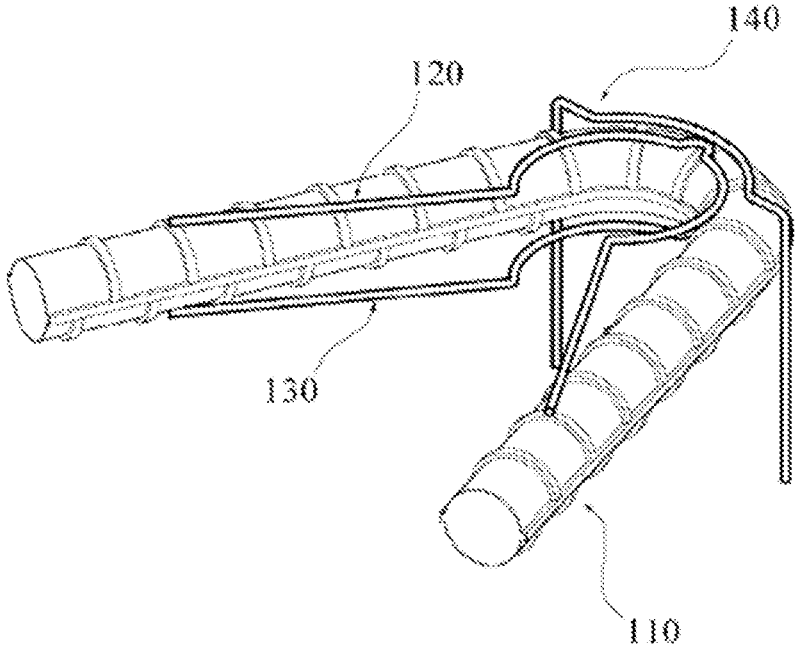
FIGS. 10 to 12 are perspective views of a V-shaped tie reinforcement according to a third embodiment of the present invention.
Figure 11:
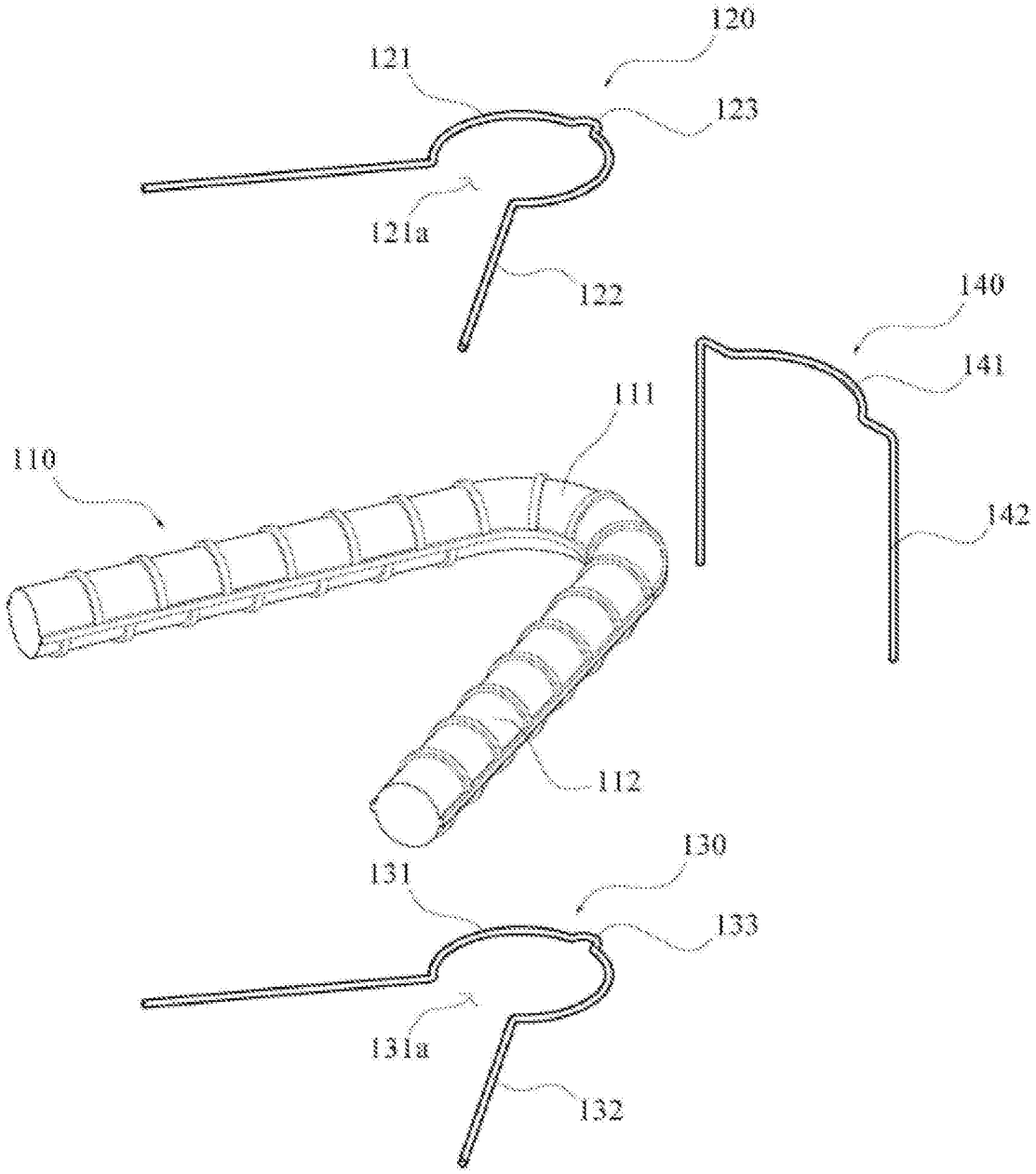
Figure 12:
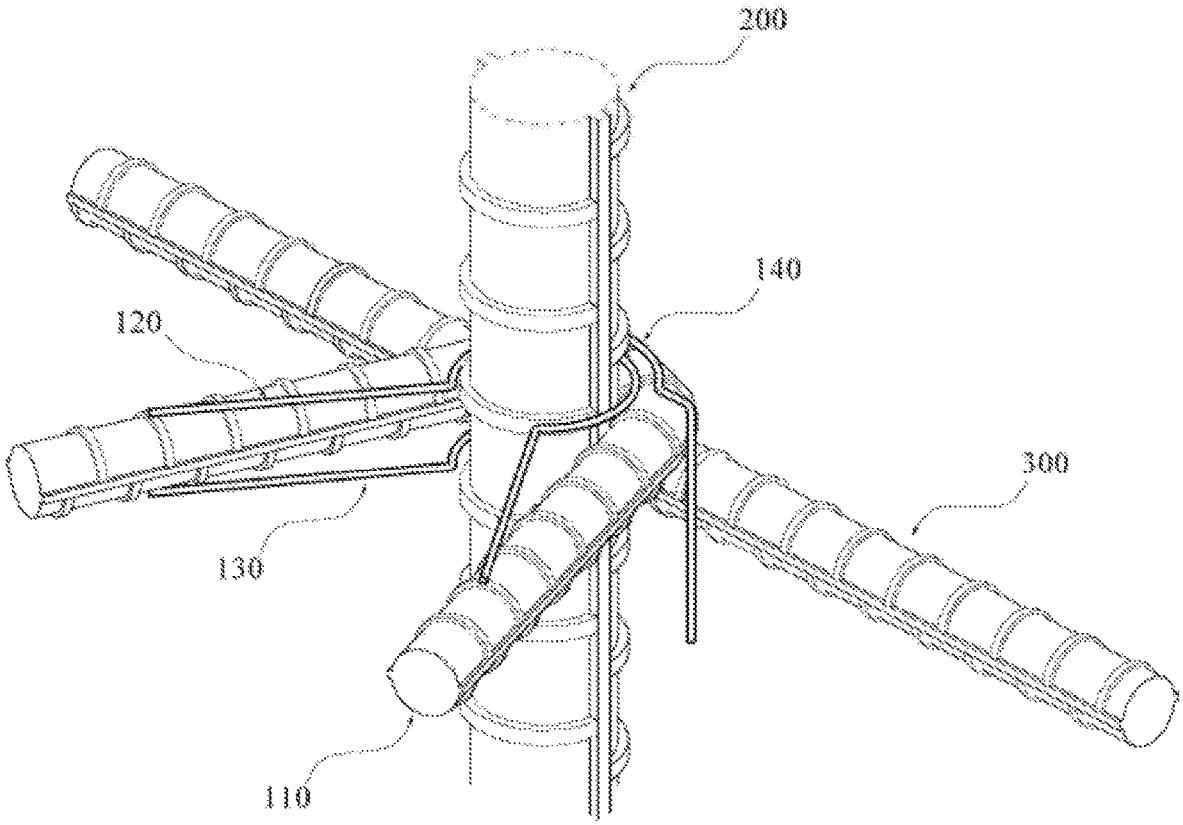

FIGS. 10 to 12 relate to a V-shaped tie reinforcement 100 according to a third embodiment of the present invention. FIG. 10 is a perspective view illustrating the entire V-shaped tie reinforcement 100. FIG. 11 is an exploded perspective view illustrating configurations of the V-shaped tie reinforcement 100. FIG. 12 is a perspective view illustrating a state in which the V-shaped tie reinforcement 100 is installed in a main reinforcement 200.

While the first and second embodiments disclose that the arc-shaped clip 121 of the tie reinforcement upper fixing member 120 is spaced apart from the V-shaped reinforcement 110, that is, that the main reinforcement 200 is inserted at a height spaced upwards from the V-shaped reinforcement 110, the third embodiment discloses that the center of the rear surface of the arc-shaped clip 121 is attached to the bending part 111 of the V-shaped reinforcement 110 through welding or by a coupling accessory, and the tie reinforcement lower fixing member 130 having the same shape as the reinforcement upper fixing member 120 is further installed.

In more detail, in the third embodiment, the tie reinforcement upper fixing member 120 is fixedly installed at an upper portion of the V-shaped reinforcement 110 at three points, and the tie reinforcement lower fixing member 130 is fixedly installed at a lower portion of the V-shaped reinforcement 110 at three points to be symmetrical to the tie reinforcement upper fixing member 120.

Accordingly, the tie reinforcement lower fixing member 130 also includes an arc-shaped clip 131 having an insertion hole 131*a*, into which the main reinforcement 200 is inserted, and lower support bars 132 bent horizontally outwards at opposite ends of the insertion hole 131*a* and ends of which are fixed to the anchor parts 112 of the V-shaped reinforcement 110.

In this way, upward and downward convexo-concave shapes are formed in the outer surfaces of the tie reinforcement upper fixing member 120 and the tie reinforcement lower fixing member 130 attached to the upper and lower sides of the V-shaped reinforcement 110 so that the V-shaped reinforcement 110 is restrained from moving upwards and downwards by an unpredicted impact during a process of laying out reinforcements or pouring concrete due to the frictional force and the not confining force of the main reinforcement.

Further, the tie reinforcement upper fixing member 120 and the tie reinforcement lower fixing member 130 are fixed to the upper and lower sides of the V-shaped reinforcement 110 at two points to prevent the anchor parts 112 of the V-shaped reinforcement 110 from being deflected.

Then, protruding welding recesses are further provided at the centers of the rear surfaces of the arc-shaped clips provided in the tie reinforcement upper fixing member 120 and the tie reinforcement lower fixing member 130 to achieve the precision and easiness of an operation of attaching the arc-shaped clips and the V-shaped reinforcement 110 through welding or by a coupling accessory.

Figure 13:
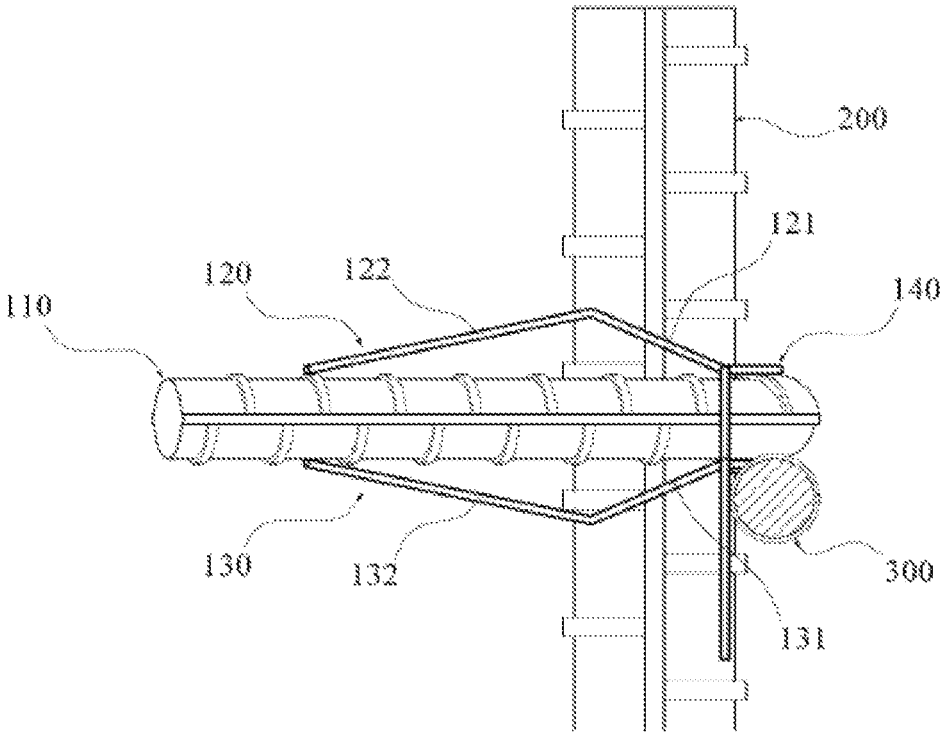
FIG. 13 is a cross-sectional view illustrating a modification of the V-shaped tie reinforcement according to the third embodiment.

All of the arc-shaped clips 121 and 131 and the upper support bars 122 or the lower support bars 132 constituting the tie reinforcement upper fixing member 120 and the tie reinforcement lower fixing member 130 may be positioned in a straight line, but as illustrated in FIG. 13, the arc-shaped clips 121 and 131 located on the upper and lower sides of the V-shaped reinforcement 110 are bent to surround the outer surface of the main reinforcement 200 at opposite inclination angles so that the frictional forces in the upward and downward directions of the main reinforcement 200 may be further increased and the slide movement may be prevented.

For example, the insertion hole 121*a* of the tie reinforcement upper fixing member 120 is configured to have an inverse V shape such that the arc-shaped clip 121 is bent upwards from the protruding recess 123 and the upper support bar 122 is bent downwards from the arc-shaped clip 121, and the insertion hole 131*a* of the tie reinforcement lower fixing member 130 is configured to have a V shape such that the arc-shaped clip 131 is bent downwards from the protruding recess 133 and the lower support bar 132 is bent upwards from the arc-shaped clip 131 so that the V-shaped reinforcement 110 is prevented from sliding to the upper and lower sides of the main reinforcement 200 even if an aperture is generated between the inner peripheral surfaces of the arc-shaped clips 121 and 131 and the main reinforcement 200.

Next, the rotation preventing member 140 commonly fixedly installed in the bending part 111 of the V-shaped reinforcement 110 in the first to third embodiments will be described.

Figure 14A:
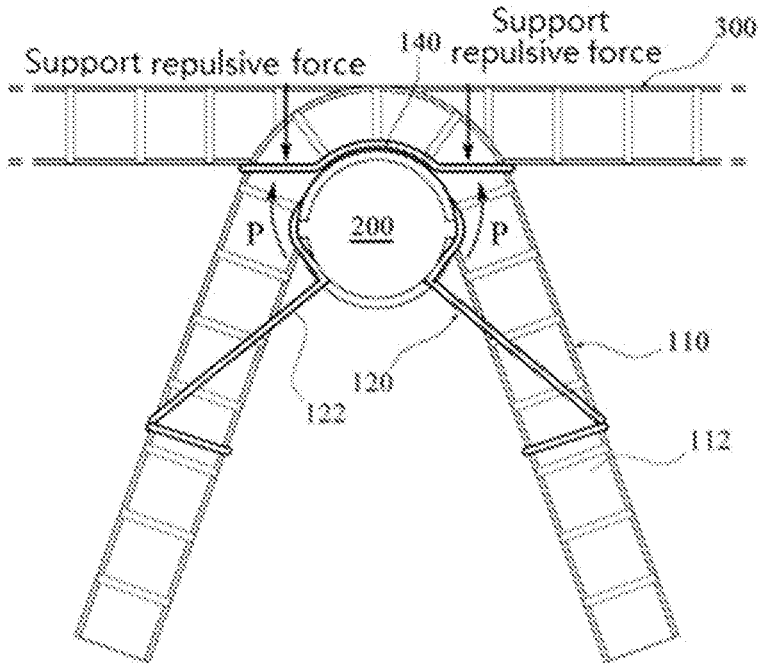
FIGS. 14A and 14B illustrate conceptual views for explaining the operational effects of a rotation preventing member constituting the V-shaped tie reinforcement of the present invention.
Figure 14B:
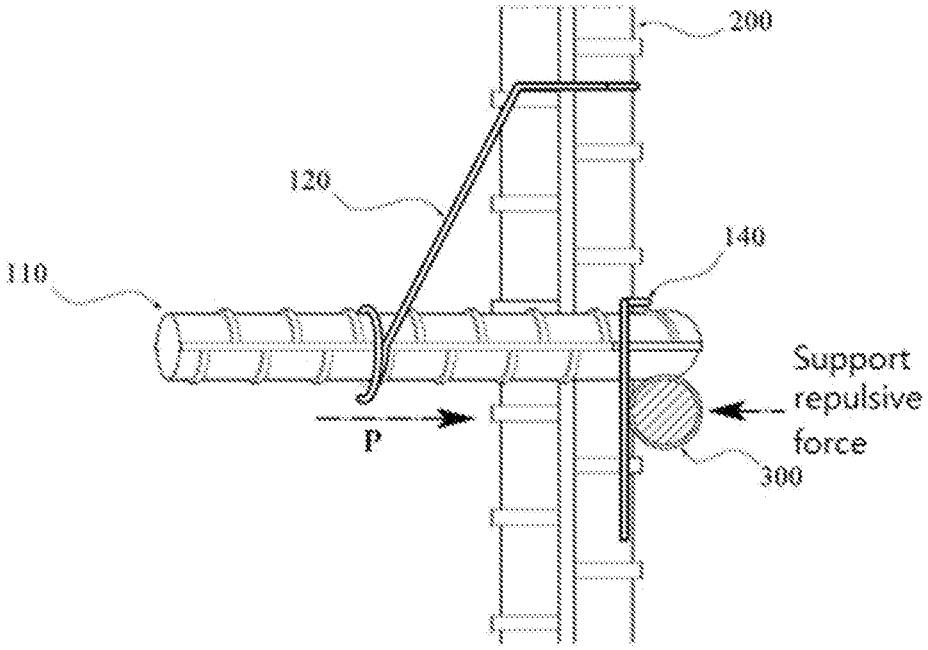

FIG. 14 is provided to explain the operational effects of the rotation preventing member 140, in which FIG. 14A is a conceptual view illustrating that the rotational preventing member 140 prevents the V-shaped reinforcement 110 from rotating leftwards and rightwards, and FIG. 14B is a conceptual view illustrating that the rotation preventing member 140 prevents the anchor parts 112 of the V-shaped reinforcement 110 from being deflected downwards, that is, from rotating downwards.

The rotation preventing member 140 includes a hanging/fixing bar 141 hung on, and welded and fixed to the upper surface of the V-shaped reinforcement 110, and a pair of prop bars 142 bent downwards at the opposite ends of the hanging/fixing bar 141. The hanging/fixing bar 141 may be installed to be hung on the upper surface of the V-shaped reinforcement 110 not only through welding but also by using another accessory.

The pair of prop bars 142 are located on opposite sides to be symmetrical to each other with respect to the center of the bending portion 111 of the V-shaped reinforcement 110, and the prop bars 142 are prevent from being rotated in opposite directions while being supported by the hoop reinforcement 300 so that the integrally bonded V-shaped reinforcement 110 is prevented from rotating leftwards and rightwards.

The outer surfaces of the prop bars 142 may be located on any one surface of the hoop reinforcement 300 surrounding the main reinforcement 200, but preferably, the V-shaped tie reinforcement 100 is prevented from being separated from the main reinforcement 200 while the arc-shaped clips 121 and 131 are retreated by an unpredicted horizontal load as illustrated in FIG. 14B by locating the prop bars 142 on the inner surface of the hoop reinforcement 300. The hanging/fixing bar 141 for the purpose has a shape that is smoothly curved inwards on a plane.

Cross fixing clips 146, into which the main reinforcement 200 is inserted, may be further provided at ends of the prop bars 142.

Figure 15:
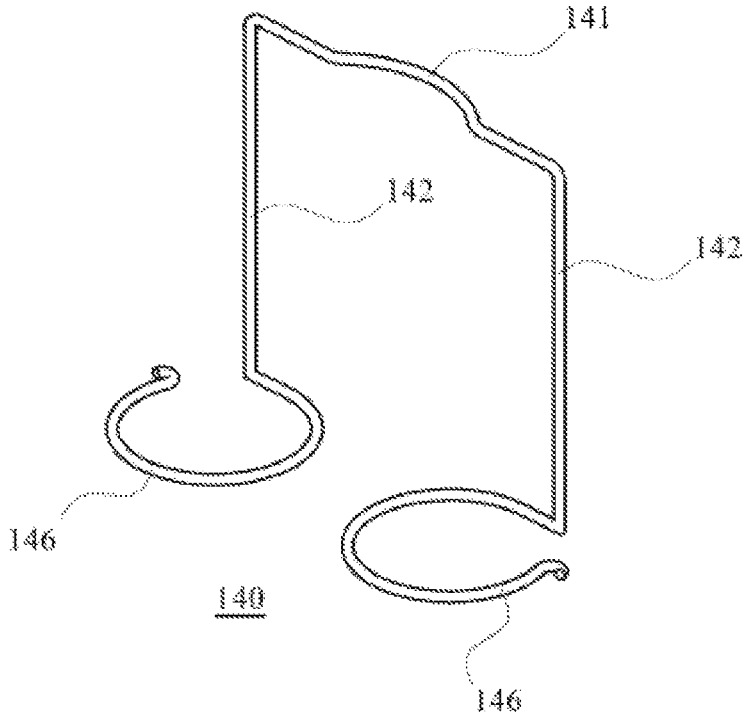
FIG. 15 is a perspective view illustrating another embodiment of the rotation preventing member.
Figure 16:
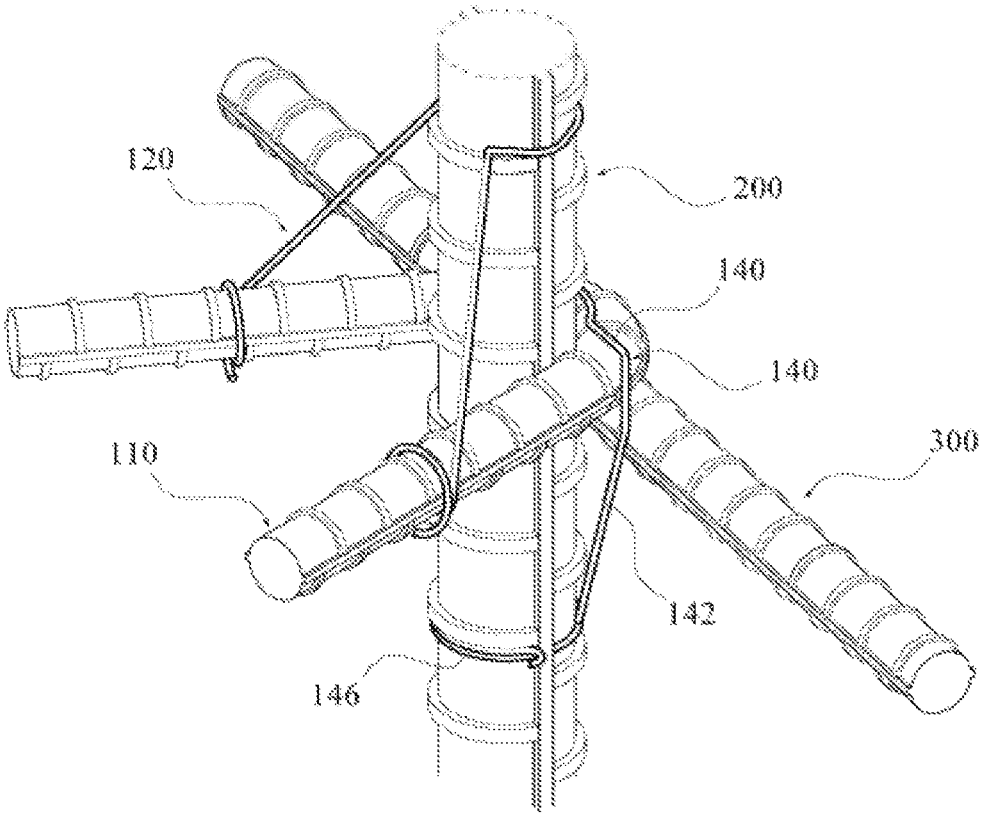
FIG. 16 is a perspective view of a state in which the V-shaped tie reinforcement provided with the rotation preventing member according to the embodiment of FIG. 15 is coupled to the main reinforcement.

FIG. 15 illustrates the rotation preventing member 140 including a cross fixing clip 146 at an end of the prop bar 142. FIG. 16 illustrates a state in which an end of the prop bar 142 is fixed to the main reinforcement 200 by the cross fixing clip 146.

The prop bars 142 provided in the cross fixing clips 146 performs the function of the extending support bars 125 of the above-described second embodiment instead to prevent the V-shaped reinforcement 110 from moving upwards by an upward/downward load that may be generated in a process of pouring concrete.

Although the present invention has been described in detail with reference to the detailed embodiments until now, the description of the present invention is a simple example for helping easy understanding of the present invention, and it will be apparent that an ordinary person skilled in the art can variously modify the present invention without departing from the scope of the present invention. Accordingly, the modifications will pertain to the scope of the present invention, which is claimed in the claims.

What is claimed is:

1. A V-shaped tie reinforcement integrally provided with a one-touch type fixing device, the V-shaped tie reinforcement comprising:

a V-shaped reinforcement comprising a bending part surrounding a main reinforcement at the center thereof, and anchor parts widened to two sides; and a fixing device comprising a tie reinforcement upper fixing member fixedly installed in the V-shaped reinforcement and connected to the main reinforcement, and a rotation preventing member fixedly installed in the bending part of the V-shaped reinforcement and configured to prevent the V-shaped 10 reinforcement connected to the main reinforcement from rotating to upper, lower, left, and right sides, wherein the tie reinforcement upper fixing member comprises:

an arc-shaped clip having an insertion hole, into which the main reinforcement is inserted; and upper support bars horizontally bent outwards from opposite ends of the insertion hole and ends of which are fixed to the anchor parts of the V-shaped reinforcement, and wherein the rotation preventing member comprises:

a hanging/fixing bar installed to be hung on an upper surface of the V-shaped reinforcement; and a pair of prop bars bent downwards from opposite ends of the hanging/fixing bar.

2. The V-shaped tie reinforcement of claim 1, wherein the upper support bars are bent to be inclined vertically downwardly from the opposite ends of the insertion hole and the ends of the upper support bars are attached and fixed to the anchor parts of the V-shaped reinforcement.

3. The V-shaped tie reinforcement of claim 2, wherein annular rings or arc-shaped clips, into which the anchor parts are inserted to be fixed, are further provided at the ends of the upper support bar.

4. The V-shaped tie reinforcement of claim 3, further comprising:

a pair of extending support bars extending downwards from the annular rings or the arc-shaped clips provided in the upper support bars and bent to be inclined downwards to be symmetrical to the upper support bars; and a pair of cross fixing clips located at ends of the pair of extending support bars and into which the main reinforcement is inserted.

5. The V-shaped tie reinforcement of claim 1, wherein the tie reinforcement upper fixing member is fixedly installed at an upper portion of the V-shaped reinforcement, and a tie reinforcement lower fixing members comprising annular rings or arc-shaped clips configured to fix the anchor parts of the V-shaped reinforcement at ends thereof are further installed at a lower portions of the V-shaped reinforcement, and wherein the tie reinforcement lower fixing member further comprises:

an arc-shaped clip having an insertion hole, into which the main reinforcement is inserted; and lower support bars bent horizontally outwards at opposite ends of the insertion hole of the tie reinforcement lower fixing member and ends of which are fixed to the anchor parts of the V-shaped reinforcement.

6. The V-shaped tie reinforcement of claim 5, wherein a protruding recess for coupling to the V-shaped reinforcement is further formed at a center of a rear surface of each of the arc-shaped clips provided in the tie reinforcement upper fixing member and the tie reinforcement lower fixing member.

7. The V-shaped tie reinforcement of claim 5, wherein the insertion hole of the tie reinforcement upper fixing member is configured to have an inverse V shape such that the arc-shaped clip is bent upwards from the protruding recess and the upper support bars are bent downwards from the arc-shaped clip, the insertion hole of the tie reinforcement lower fixing member is configured to have a V shape such that the arc-shaped clip is bent downwards from the protruding recess and the lower support bars are bent upwards from the arc-shaped clip, and the upper and lower arc-shaped clips surround an outer surface of the main reinforcement, which is inserted into the arc-shaped clips at opposite inclination angles.

8. The V-shaped tie reinforcement of claim 1, wherein the rotation preventing member is configured such that an outer surface of the pair of prop bars is located on an inner surface of a hoop reinforcement supporting the main reinforcement.

9. The V-shaped tie reinforcement of claim 8, wherein a pair of cross fixing clips, into which the main reinforcement is inserted, are further provided at ends of the pair of prop bars.

10. The V-shaped tie reinforcement of claim 1, wherein the hanging/fixing bar of the rotation preventing member is fixed to the upper surface of the V-shaped reinforcement through welding or by a coupling accessory.

11. The V-shaped tie reinforcement of claim 5, wherein the tie reinforcement upper fixing member and the tie reinforcement lower fixing member are integrally formed with the annular rings or the arc-shaped clips configured to fix the anchor parts of the V-shaped reinforcement.

12. The V-shaped tie reinforcement of claim 5, wherein the tie reinforcement upper fixing member and the tie reinforcement lower fixing member are fixed to the bending part through welding or by a coupling accessory, and the rotation preventing member is fixed to an upper surface of the bending part.

* * * * *